US006058610A

United States Patent [19]

Leang

[11] Patent Number: 6,058,610

[45] Date of Patent: May 9, 2000

[54] DECORATIVE FOOD CUTTER

[76] Inventor: Irene Leang, 13612 Heather Way, Hawthorne, Calif. 90250

[21] Appl. No.: 09/225,286

[22] Filed: Jan. 4, 1999

[51] Int. Cl.[7] ..... B26B 3/00

[52] U.S. Cl. ..... 30/316; 30/279.2; 30/280; 30/301; 30/314

[58] Field of Search ..... 30/113.1, 113.3, 30/279.2, 280, 314, 316, 315, 301

[56] References Cited

U.S. PATENT DOCUMENTS

| | | | |
|---|---|---|---|
| 198,219 | 12/1877 | Schell, Jr. | 30/301 |
| 220,781 | 10/1879 | West | 30/301 X |
| 1,253,836 | 1/1918 | Katzinger | 30/301 |
| 1,293,351 | 2/1919 | Creasey | 30/113.1 |
| 1,446,513 | 2/1923 | Morris | 30/301 |
| 1,674,271 | 6/1928 | Winquist | 30/316 X |
| 2,620,755 | 12/1952 | Lewis | 30/316 X |
| 3,363,311 | 1/1968 | Jowers | 30/113.3 |
| 4,310,969 | 1/1982 | Cannizzaro et al. | 30/113.1 |
| 4,596,073 | 6/1986 | Ewald | 30/113.1 |

FOREIGN PATENT DOCUMENTS

| | | | |
|---|---|---|---|
| 13187 | 6/1905 | United Kingdom | 30/301 |

*Primary Examiner*—Rinaldi I. Rada
*Assistant Examiner*—Boyer Ashley
*Attorney, Agent, or Firm*—Irving Keschner

[57] ABSTRACT

A simplified cutter for providing decorative pieces to enhance the visual appearance of various dishes. The cutter comprises a hallow cylindrical member secured to a disk shaped lip member. A series of shaped cutter elements are secured to the inside surface of the cylindrical member. In operation, the cutter is positioned on the top portion of the item being cut, such as carrots, and the user presses down on the lip, or collar, portion. The vertically extending cutter surfaces cut the item along the length of the item, remainder of the item having a center portion with the circumference having a shape corresponding to the mirror image of the cutter surface.

7 Claims, 1 Drawing Sheet

FIG. 1
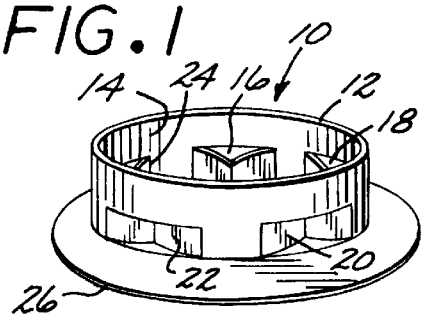
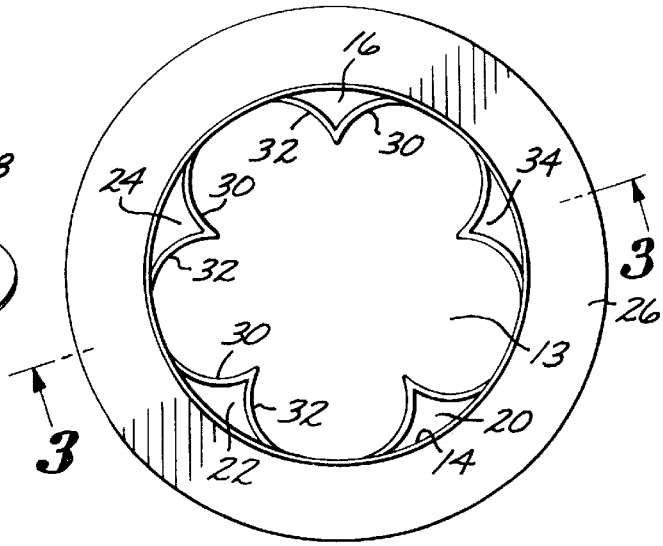
FIG. 2
FIG. 3
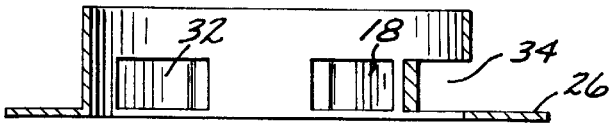
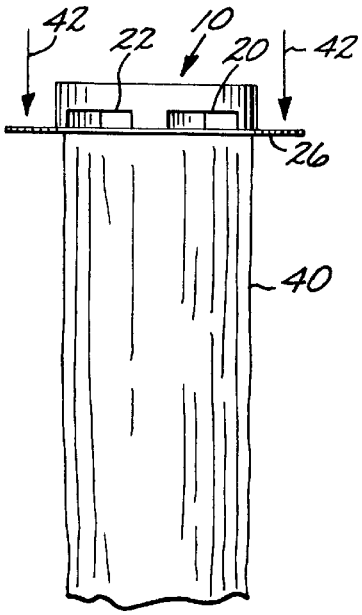
FIG. 4
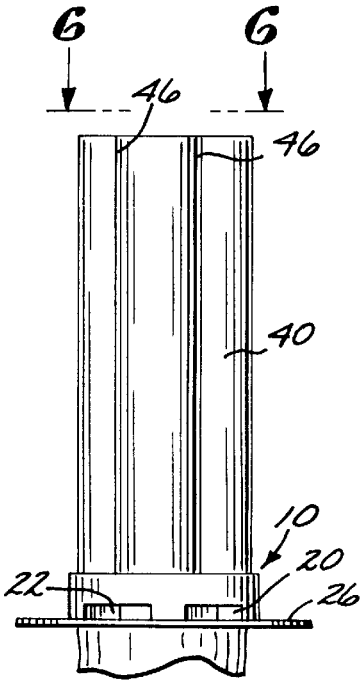
FIG. 5
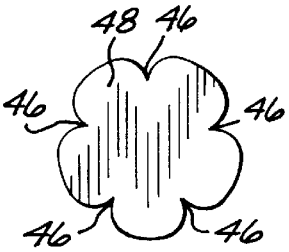
FIG. 6

DECORATIVE FOOD CUTTER

BACKGROUND OF INVENTION

1. Field of Invention

The present invention provides a manually operated cutter wherein particular types of food, such as carrots, are cut into fanciful shapes for decorative purposes.

2. Description of Prior Art

Decorative food cutters have been commercially available for many years. However, they are typically bulky in weight and size, have a number of mechanical parts and are relatively expensive.

What is desired is to provide a cutter for providing food pieces which are decorative and enhance the visual appearance of various food dishes which is easy to use and is relatively inexpensive.

SUMMARY OF THE PRESENT INVENTION

The present invention provides a simplified cutter for providing decorative pieces to enhance the visual appearance of various food dishes. The cutter comprises a hollow cylindrical member secured to a disk shaped lip member. A series of shaped cutters are secured to the inside surface of the cylindrical member. In operation, the cutter is positioned on the top portion of the item being cut, such as carrots, and the user presses down on the lip, or collar, portion. The vertically extending cutter surfaces cut the item along the length of the item , the remainder of the item having a center portion with the circumference having a shape corresponding to the mirror image of the cutter surface.

DESCRIPTION OF THE DRAWING

For a better understanding of the invention as well as other objects and further features thereof, reference is made to the following description which is to be read in conjunction with the drawing wherein:

FIG. 1 is a perspective view of the novel cutter of the present invention;

FIG. 2 is a plane view of the novel cutter shown in FIG. 1;

FIG. 3 is a cross-sectional view along line 3—3 of FIG. 2;

FIG. 4 illustrates the initial position of the cutter on a food item;

FIG. 5 illustrates the position of the cutter towards the end of its movement along the food item; and FIG. 6 is a view along line 6—6 of FIG. 5 showing a plane view of the cut food item.

DESCRIPTION OF THE INVENTION

Referring now to FIGS. 1–3, the cutter 10 of the present invention is illustrated. Cutter 10 comprises a cylindrical member 12 (preferably made of metal although other materials could be used) having a central aperture 13 with an internal, or inside, surface 14. A plurality of shaped cutter elements 16, 18 . . . 24 are attached to, or formed integral with, internal surface 14. Although shown extending partially along surface 14 in the vertical direction, the cutter elements may extend along the entire length of surface 14. A collar, or lip, portion 26 is attached to the bottom surface of member 12 as illustrated.

As shown, the cutter elements comprise convex shaped cutting surfaces 30 and 32 preferably made of metal (it should be noted that other shaped cutter surfaces can be used, depending upon the decorative design desired). FIG. 3 illustrates the spaces 34 formed between the cutter surfaces 30 and 32 to provide an area whereat the unused food portions can be cut and removed.

In operation, cutter 10 is positioned on the top of food item 40, such as a carrot. The user then pushes down on collar portion 26 in the direction of arrow 42. FIG. 5 illustrates the situation wherein cutter 10 has moved down the food item 40 in the longitudinal direction resulting in the cutout portions 46 (discarded food portions not shown). FIG. 6 is a plane view illustrating the shape of the remaining food item 48, similar to a five leaf clover. Once the cutting operation is completed, the food item can be cut to a desired thickness, thus forming a plurality of clover shaped food pieces for decorative use.

The cutter 10 can be designed such that the cutter elements can be removably attached to wall portion 14 (instead of integral with surface 14 as illustrated) allowing various cutter elements to be used therewith.

The present invention thus provides a simple reliable and relatively inexpensive food cutter to provide various shaped food pieces for decorative purposes.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. A food cutter comprising:

a cylindrical member having a longitudinal axis, a central open section, top and bottom surfaces and an inner surface;

a lip portion coupled to the bottom surface of the said cylindrical member, said lip portion extending beyond said bottom surface of said cylindrical member in a direction substantially perpendicular thereto;

a plurality of cutter members attached to the inner surface of said cylindrical member, each of said cutter members comprising a plurality of curved cutting surfaces extending in the direction of the longitudinal axis of said cylindrical member and extending into the central open section; and wherein the lip portion is located closer to the cutter members than to the top surface.

2. The food cutter of claim 1 wherein said cutter members extend along a portion of the inner surface of said cylindrical member.

3. The food cutter of claim 1 wherein said cutter members extend substantially along the entire inner surface of said cylindrical member.

4. The food cutter of claim 1 wherein said cutting surfaces are convex shaped.

5. The food cutter of claim 1 wherein said central open section is adapted to be positioned over food which is to be cut.

6. The food cutter of claim 1 wherein openings are formed between the cutting surfaces of each cutter member and the inner surface of said cylindrical member to provide an area whereat unused food portions are cut and removed.

7. The food cutter of claim 1 wherein said cutter members are removably attached to the inner surface of said cylindrical member.

* * * * *